United States Patent [19]

Goshow

[11] Patent Number: 4,702,176

[45] Date of Patent: Oct. 27, 1987

[54] SHELF FOR HOSPITAL BED

[76] Inventor: Henry M. Goshow, 2343 Bethlehem Pike, Hatfield, Pa. 19440

[21] Appl. No.: 899,723

[22] Filed: Aug. 25, 1986

[51] Int. Cl.[4] ..... A47F 5/12

[52] U.S. Cl. ..... 108/9; 108/49; 248/210

[58] Field of Search ..... 108/9, 49, 47; 297/194; 5/507; 248/105, 214, 210, 238

[56] References Cited

U.S. PATENT DOCUMENTS

| | | | |
|---|---|---|---|
| 355,911 | 1/1887 | Bartow . | |
| 725,593 | 4/1903 | Schleuning . | |
| 1,255,696 | 2/1918 | Bochard | 248/210 |
| 1,305,922 | 6/1919 | Moller | 248/236 |
| 1,907,780 | 5/1933 | Froelich . | |
| 2,704,235 | 3/1955 | Bion . | |
| 2,710,051 | 6/1955 | Greenberg . | |
| 2,865,432 | 12/1958 | Dearing | 108/47 X |
| 3,054,122 | 9/1962 | Sarkus . | |
| 3,147,948 | 9/1964 | Evanoff . | |
| 3,220,025 | 11/1965 | Nelson | 108/49 |
| 3,276,045 | 10/1966 | Bement . | |
| 3,543,312 | 12/1970 | Cofferi . | |
| 3,625,160 | 12/1971 | Bergman . | |
| 3,822,846 | 7/1974 | Jesionowski | 248/210 |
| 3,987,993 | 10/1976 | Hopkins | 248/210 |
| 4,576,351 | 3/1986 | Brink | 297/194 X |

*Primary Examiner*—Peter A. Aschenbrenner
*Attorney, Agent, or Firm*—Steele, Gould & Fried

[57] ABSTRACT

A shelf construction for use with an elevating type of hospital bed is disclosed. The shelf construction includes an upper bracket having a depending flange for removably resting upon the rail of the bed. A shelf is pivotally interconnected with the bracket through front and rear links to permit angular adjustment of the shelf relative to changes in angularity of the rail to thereby maintain the shelf in level orientation. One of the links is provided with an elongated, longitudinally aligned slot to facilitate the angular adjustment of the shelf relative to the upper bracket. In a second embodiment of the invention, the shelf and the upper bracket are affixed in a preselected angular offset relationship to allow the shelf to be angularly offset from the rail of the bed.

5 Claims, 8 Drawing Figures

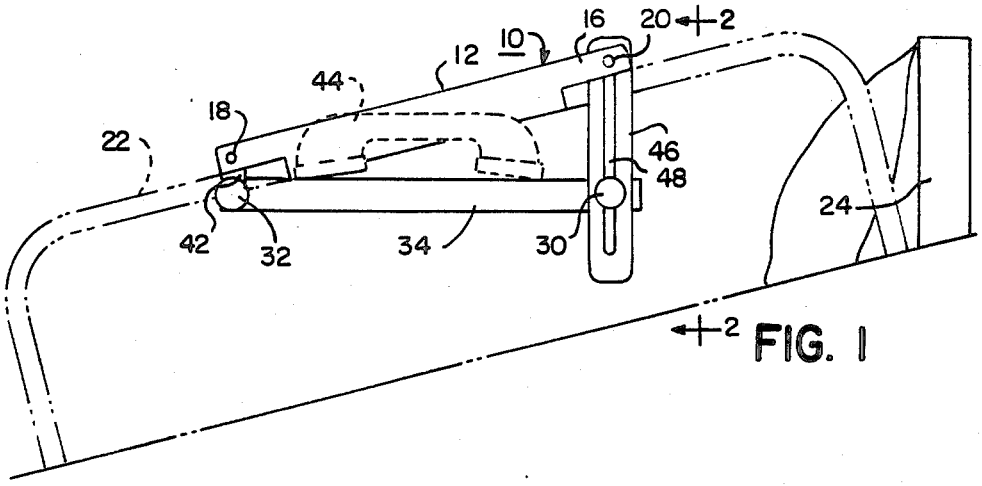
FIG. 1
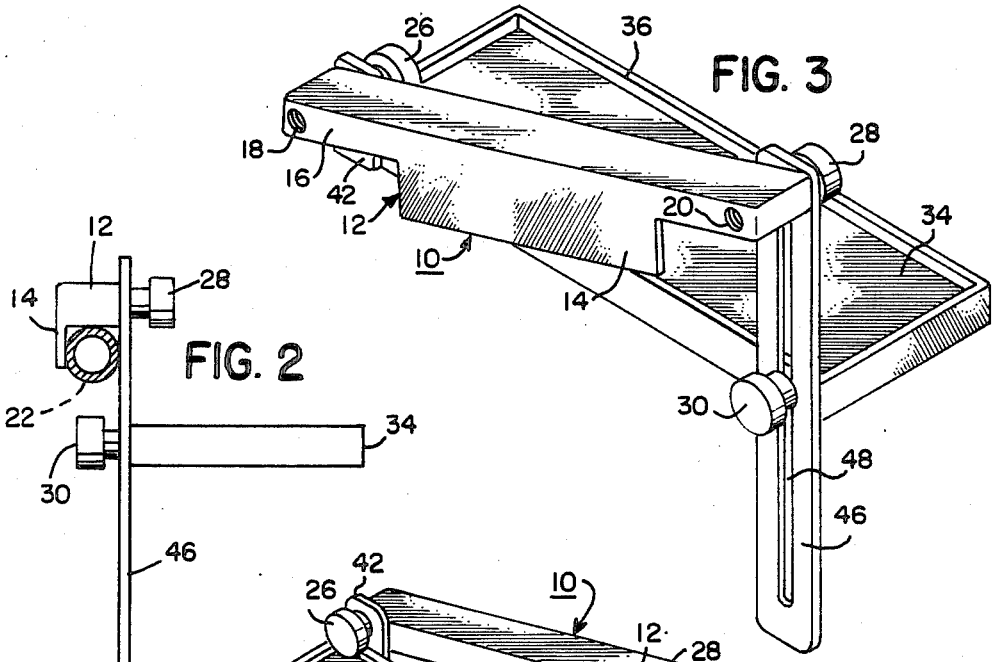
FIG. 3
FIG. 2
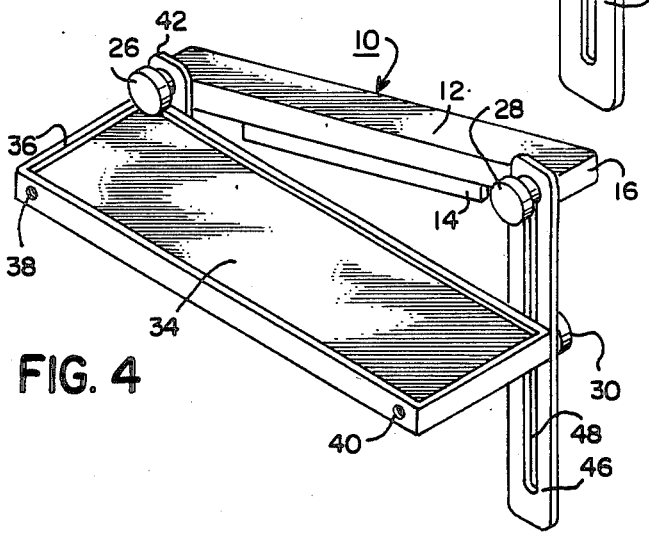
FIG. 4

SHELF FOR HOSPITAL BED

BACKGROUND OF THE INVENTION

1. Field of the Invention

The present invention relates generally to the field of shelving, and more particularly, is directed to a shelf designed for holding a telephone and other articles in relatively level orientation in association with a hospital type bed.

2. Description of the Prior Art

Hospital beds have long presented problems to the users thereof in view of the inherent difficulties involved in storing and using bed associated articles due to the elevating nature of most such beds. Usually, hospital type beds include one or more elevating mechanisms which are provided for the comfort and treatment of the hospital patients. Particularly, it is common to elevate the head area of the bed to provide additional comfort to the occupant when engaging in such usual and repetitive activities as eating or reading. It will be appreciated that the users of such hospital type beds are normally more or less incapacitated and accordingly, any additional comfort or ease in use which can be provided for the patient would be most beneficial.

In view of the obvious need to provide for the comfort of hospital patients, numerous bed-attached devices have been developed by prior workers in the art. Exemplary of such prior art devices are the tray attachment for bedsteads disclosed in U.S. Pat No. 355,911 to Bartow, Jr.; the combined bed tray and night stand disclosed in U.S. Pat. No. 3,054,122 to Sarkus; the adjustable book holding means disclosed in U.S. Pat. No. 3,147,948 to Evanoff; the table attachment means disclosed in U.S. Pat. No. 3,220,025 to Nelson; the bed tray and bed combination disclosed in U.S. Pat. No. 3,276,045 to Bement; the table unit mountable on a bed frame disclosed in U.S. Pat. No. 3,543,312 to Pofferi; and the bed rail attached device disclosed in U.S. Pat. No. 4,357,881 to DeLong.

However, so far as is known to the applicant, even though numerous hospital bed-attached devices have previously been developed, no one has to date disclosed a simple bed-attached shelf which may conveniently be employed to maintain an instrument, such as a telephone in level association with the bed and which may include adjustable means to hold the telephone in horizontal orientation under all elevated positions of the hospital bed itself.

SUMMARY OF THE INVENTION

The present invention relates generally to the field of equipment suitable for use with hospital beds, and more particularly, is directed to a portable shelf suitable for attaching to the handrail of an elevating type of hospital bed.

In the preferred embodiment, the shelf of the present invention is adjustable in nature and includes means to permit the shelf to be oriented in a generally horizontal plane in all angularly elevated positions of the hospital bed itself. Additionally, the preferred embodiment incorporates means to allow the adjustable shelf to be equally applicable to either the left hospital bed rail or the right hospital rail. In a second embodiment, a shelf is provided in angular orientation relative to its supporting structure but no adjustable features are incorporated. In this second embodiment, it is contemplated that one shelf unit will be designed and provided for right hospital bed rail attachment and a similar, but opposite construction will be employed when it is desired to equip the left hospital bed rail with such a device.

In accordance with the teachings of the present invention, the shelf construction comprises generally a planar member or shelf of suitable size to receive and retain thereon a separate, preselected device or apparatus, for example a telephone or perhaps a radio. An upper bracket stationarily secures to the hospital bed rail in generally longitudinal alignment therewith whereby the upper bracket is angularly elevatable as the hospital bed rail itself is elevated. It is an object of this invention to provide an upper bracket construction that can be readily secured to and removed from the hospital bed rail whenever so desired.

The upper bracket comprises pin connections at both sides at each end to facilitate angular adjustment of the shelf relative to the upper bracket in order to horizontally orient the shelf regardless of the angular position of the upper bracket itself. An adjusting link is pivotally connected to one end of the upper bracket and includes a longitudinally extending slot to slidingly receive therein a pin which is carried at the side of one of the shelf construction. A short link interconnects the other end of the shelf construction with the second end of the upper bracket to compensate for any length differential as the shelf pin moves within the longitudinally extending slot of the height adjusting link. Both sides of each end of the shelf are provided with threaded sockets to threadedly receive threaded connectors therein in a manner to permit a single shelf construction to be employed with either right hand or left hand bed rail installation.

By providing suitable threaded sockets and threaded fasteners, the entire device can be rendered easily interchangeable between left-hand and right-hand constructions to thereby allow the same adjustable shelf-members to be employed at either the right hospital bed rail or the left hospital bed rail.

Accordingly, it is an object of the present invention to provide an improved hospital bed shelf of the type set forth.

It is another object of the present invention to provide a novel shelf for a hospital bed which comprises an upper bracket for association with either rail of a hospital bed, a shelf which is pivotally connected to one end of the upper bracket and an adjustable link interconnected between the other end of the upper bracket and the second end of the shelf to permit adjusting the shelf for substantial horizontal orientation in response to any elevating movement of the hospital bed.

It is another object of the present invention to provide a novel shelf for a hospital bed which incorporates means to removably affix the shelf to the handrail of a hospital bed, means to change the orientation of the shelf from the orientation of the hospital bed rail and means to secure the shelf in generally horizontal alignment without being dependent upon any particular angularly adjusted positioned of the hospital bed itself.

It is another object of the present invention to provide a novel shelf for a hospital bed that is universally adaptable for installation upon either the left hospital bed rail or the right hospital bed rail.

It is another object of the present invention to provide a novel shelf for a hospital bed that is simple is design, inexpensive in manufacture and trouble-free when in use.

Other objects and a fuller understanding of the invention will be had by referring to the following description and claims of the preferred embodiments, taken in conjunction with the accompanying drawings, wherein like reference characters refer to similar parts throughout the several views and in which:

BRIEF DESCRIPTION OF THE DRAWINGS

FIG. 1 is a side elevational view of the adjustable shelf of the present invention in use in conjunction with a hospital bed, the bed handrail being shown in phantom lines for purposes of association.

FIG. 2 is an end elevational view of the adjustable shelf, looking from line 2—2 on FIG. 1 in the direction of the arrows.

FIG. 3 is an enlarged, perspective view of the adjustable shelf constructed in accordance with the teachings of the present invention.

FIG. 4 is a perspective view of the adjustable shelf looking from the opposite side.

DESCRIPTION OF THE PREFERRED EMBODIMENTS OF THE INVENTION

Figure 7:
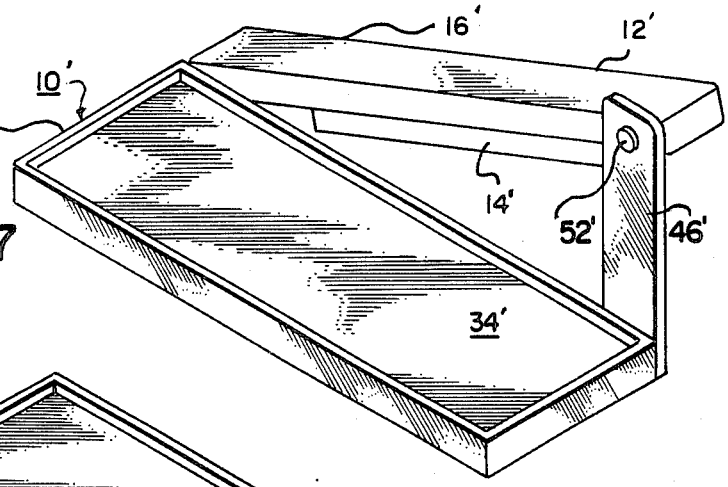
FIG. 7 is a perspective view of a second embodiment of the shelf suitable for use with the right bed handrail.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIGS. 1–4 an adjustable shelf 10 constructed in accordance with the teachings of the present invention. The adjustable shelf is particularly designed to be adaptable for use with elevating type beds, for example hospital beds. It will be appreciated that when a person is bedridden in a hospital, there are many occasions wherein the patient will have limited mobility and ordinary simple exercises such as reaching for a telephone or for other implements in or about the bed can become a considerable chore or even an impossibility. The adjustable shelf of the present invention provides a handy working surface which may be easily oriented into a generally horizontal plane to thereby provide a convenient, readily accessible, level surface interiorly of the periphery of the bed for the immediate use and convenience of the occupant.

The adjustable shelf 10 comprises generally rectangular platform or shelf 34 which may be of suitable size to maintain thereon a telephone, radio or other item which is desirably associated with a hospital bed 24. Most hospital beds include bed elevating mechanisms (not shown) which may be hand or motor operated to elevate portions of the bed for the comfort or treatment of the occupant. When the head of the bed is elevated, it is the common practice for the associated bed handrail 22 to similarly elevate to thereby provide a degree of safety and utility for the bed patient. The adjustable shelf 10 of the present invention comprises a stationary upper bracket 12 which comprises an elongate body 16 and a downwardly depending outer flange 14. The bracket 12 has been particularly designed to facilitate easy connection and disconnection of the adjustable shelf to and from the bed movable rail 22 in all elevated positions of the bed rail. At best seen in FIG. 1, it will be appreciated that the adjustable shelf 10 can be longitudinally adjusted relative to the rail 22 to position the rectangular shelf 34 in any longitudinal arranged position that is most convenient to the patient.

Both sides of the forward and rearward ends of the shelf 34 are provided with transversely opposed threaded sockets 38, 40 to receive therein thumb screws or other fasteners 30, 32 in a manner to be easily tightened or loosened to facilitate adjustment. By providing the threaded sockets on both sides of the forward and rearward ends of the shelf 34, the same shelf and the same parts can be utilized to permit universal adaptability of the adjustable shelf 10 to permit installation upon either the left rail of the bed or the right rail of the bed, depending upon the desires and needs of the patient.

To facilitate horizontal adjustment of the shelf 34 in response to elevation of the bed and consequently the bed rail 22, a short forward link 42 and a longer, rearward adjusting link 46 are adjustably connected respectively to the forward and rearward threaded sockets 38, 40 which are positioned along one side of the shelf 34. Suitable thumb screws 30, 32 are employed for this purpose to facilitate easy adjustment.

Still referring to FIGS. 1–4, it will be seen that the short forward link 42 additionally connects to the forward threaded socket 18 which is provided at the forward end of the stationary bracket body 16 through a similar thumb screw arrangement 26. The upper end of the adjusting link 46 is adjustably connected to the rearward end of the bracket 16 at the rearward threaded socket 20 thereof by employing a rearward thumb screw 28 in an adjustable manner.

As best seen in FIGS. 1, 3 and 4, the rearward shelf thumb screw 30 adjustable connects to the adjusting link 46 through an elongated, longitudinally extending adjusting slot 48 to permit the rearward end of the shelf 34 to be raised or lowered relative to the rearward end of the stationary bracket 12, depending upon the angularity of the bed rail 22 and the wishes of the user. Any length adjustments that may be required due to the raising and lowering of the shelf 34 using the adjusting slot 48 can be compensated at the forward, short link 42 which is free to pivot about either the upper forward thumb screw 26 or the lower forward thumb screw 32.

In order to use the adjusting shelf 10 of the present invention, it must first be determined whether the adjustable shelf is to be utilized with either the left hand rail 22 or the right rail 22 of the bed 24. It is intended that the shelf 34 itself will extend interiorly over the bed and that the upper bracket flange 14 will be positioned over the bed rail 22 exteriorily of the bed 24. Accordingly, the parts should be arranged for either left hand or right hand installation. As above set forth, both the shelf 34 and the stationary bracket 12 are arranged for universal adaptability for either left hand or right hand use. To facilitate universal application of the parts, it will be noted that a pair of left and right threaded sockets 38 are provided at the sides of the forward end of the shelf 34 and a pair of left and right threaded sockets 40 are provided at the sides of the rearward end of the shelf 34. Similarly, a pair of left and right threaded sockets 18 are provided at the sides of the forward end of the stationary bracket 12 and a pair of left and right threaded sockets 20 are provided at the sides of the rearward end of the stationary bracket 12.

Figure 5:
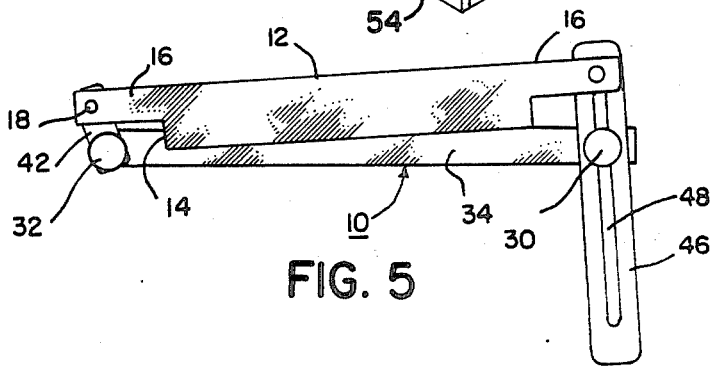
FIG. 5 is a side elevational view of the adjustable shelf in a first position.
Figure 6:
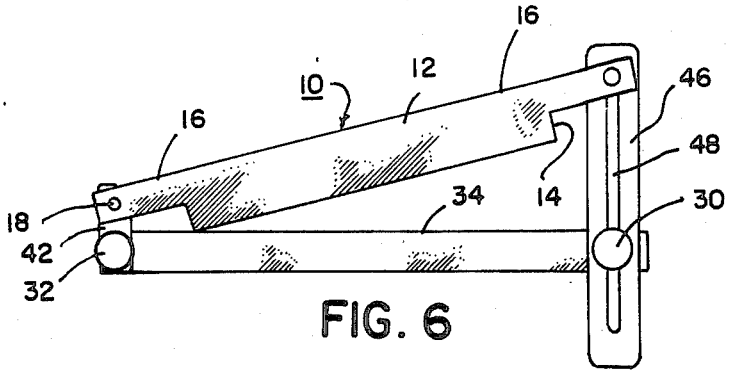
FIG. 6 is a side elevational view similar to FIG. 5 showing the adjustable shelf in a second position.

With the parts properly arranged for either left hand or right hand rail installation, the stationary bracket flange 14 is positioned over the outer periphery of the rail 22 and the short forward link 42 and longer adjusting link 46 are positioned over the inner periphery of the rail 22. See FIG. 2. This provides an extremely sturdy, though temporary, interconnection. Once the adjustable shelf is affixed temporarily over the bed rail 22, then, by first loosening and then tightening the plurality of thumb screws, 26, 28, 30, 32, the shelf 34 can be positioned in horizontal alignment (or any other desired angular position), no matter what may be angularity of the bed hand rail, in accordance with the wishes of the user. When the angularity of the shelf 34 is properly determined, no matter what may be the angularity of the bed rail 22 itself, the plurality of thumb screws 26, 28, 30, 32 can then be readily tightened to thereby provide a relatively easily arranged and easily adjusted bedside shelf. A telephone 44 or any other desired accessory can then be positioned upon the angularly adjusted shelf 34 for the use and benefit of the patient. As illustrated in FIGS. 5 and 6, the parts easily pivot about the forward and rearward shelf threaded sockets 38, 40 and the forward and rearward bracket threaded sockets 18, 20 for shelf angularity adjusting purposes. The short link 42 is designed to angularly offset as necessary to compensate for any required length adjustment as the shelf 34 is angularly raised or lowered.

Figure 8:
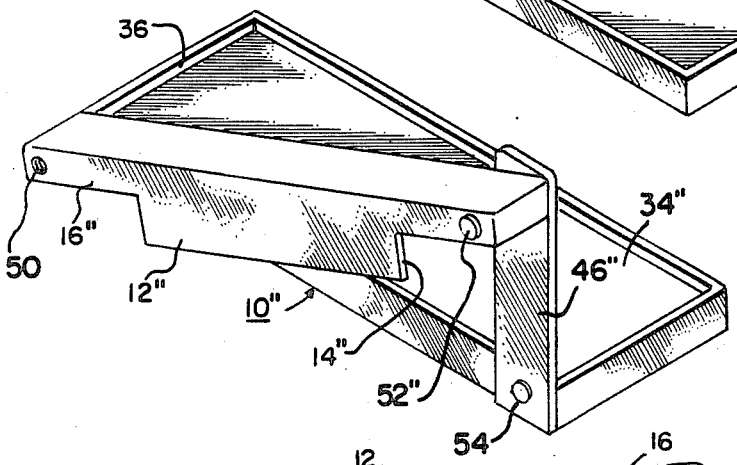
FIG. 8 is a perspective view similar to FIG. 7 showing a shelf suitable for use with the left handrail of a hospital bed.

In order to provide a less expensive and less complicated bed shelf construction, as illustrated in FIGS. 7 and 8, a stationary shelf 10' can be provided for use with the right bed rail 22 and a similar, but opposite stationary shelf 10'' can be provided for use with the left bed rail 22 if so desired. Each shelf 10', 10'' comprises a stationary platform 34', 34'' which is connected at its forward end directly to the forward end of a stationary bracket 12', 12''. A suitable pin 50 or other known type of fastener may be employed for this purpose. Similarly, the upper end of the rearward link 46', 46'' can be directly connected to the rearward end of the bodies 16', 16'' of the stationary brackets 12', 12'' by employing a rearward pin 52', 52'' or other fastener in the usual manner. In the stationary type of construction, the lower ends of the long links 46', 46'' are directly connected to the rearward ends of the respective shelves 34', 34'' by employing suitable pin 54 or other fastening means in well known manner. When using the non-adjustable shelf construction 10', 10'', it will be noted that the respective flanges 14', 14'' should be positioned in contact with the outer periphery of the hospital bed rail 22 in the manner hereinbefore described and as illustrated in FIG. 2.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A shelf construction for an adjustable type of hospital bed of the type including an angularly elevating rail comprising a planar shelf adapted to be easily connected to the hospital bed, the shelf having first and second ends;

bracket means pivotally connected to the shelf to removably affix the shelf to the said angularly elevating hospital bed rail, the bracket means comprising an elongate body having first and second ends and a flange depending along one side of the body, the flange being adapted to contact the periphery of the angularly elevating bed rail;

link means intermediate the shelf and the bracket means to change the orientation of the plane of the shelf relative to a longitudinal plane drawn through the elevating rail, the link means comprising an elongated link, the elongated link being interconnected between one end of the shelf and one end of the bracket means, the elongated link being provided with a longitudinally extending slot, and a short link, the short link being interconnected between the second end of the shelf and the second end of the bracket means, the elongate body of the bracket means comprising a first side and a second side and wherein the elongated link and the short link connect to the body at one side and the flange depends from the other side of the body; and means to secure the shelf in generally horizontal alignment without regard to any particular angularly adjusted position of the hospital bed itself.

2. The shelf of claim 1 wherein the means to secure comprises a first threaded fastener interconnecting the short link to the bracket means and a second fastener connecting the elongated link to the bracket means.

3. The shelf of claim 1 wherein the second fastener is inserted into the longitudinally extending slot, whereby movement of one end of the shelf relative to one end of the bracket means is facilitated.

4. The shelf of claim 3 wherein the fasteners comprise hand turnable nuts, the hand turnable nuts being adapted to lock the shelf, the bracket means and the link means in any desired relative angular position.

5. The shelf of claim 1 wherein the flange contacts the outer periphery of the angularly elevating rail and the links contact the outer periphery of the angularly elevating rail, the points of contact between the rail and the flange and the rail and the links being substantially diametrically opposite.

* * * * *